US008448745B2

(12) United States Patent
Crookston

(10) Patent No.: US 8,448,745 B2
(45) Date of Patent: May 28, 2013

(54) SHEATHING EDGE PROTECTOR AND ROOF SAFETY ANCHOR ASSEMBLY INCORPORATING THE SAME

(76) Inventor: Lawrence A. Crookston, Barberton, OH (US)

( * ) Notice: Subject to any disclaimer, the term of this patent is extended or adjusted under 35 U.S.C. 154(b) by 0 days.

(21) Appl. No.: 13/160,217

(22) Filed: Jun. 14, 2011

(65) Prior Publication Data

US 2012/0317892 A1 Dec. 20, 2012

(51) Int. Cl.
*E06C 7/18* (2006.01)

(52) U.S. Cl.
USPC ..... 182/3; 248/237; 52/749.12; 52/92.2

(58) Field of Classification Search
USPC ..... 52/127.5, 696, 712, 749.12, 92.2, 52/641, 645, 695, 633, 634, 635, 638, 745.21, 52/93.1, 716.8, 800.1, 800.11, 800.12, 800.18; 182/3, 45; 411/461–468; 248/148, 237
See application file for complete search history.

(56) References Cited

U.S. PATENT DOCUMENTS

| | | | | |
|---|---|---|---|---|
| 1,620,933 | A * | 3/1927 | Wilcox | 52/717.01 |
| 3,162,719 | A | 12/1964 | Mulford | |
| 3,423,898 | A | 1/1969 | Tracy et al. | |
| 3,703,304 | A | 11/1972 | Losee | |
| 3,708,942 | A | 1/1973 | Leonard | |
| 3,769,916 | A * | 11/1973 | Hogan | 104/173.1 |
| 4,910,934 | A | 3/1990 | Hennings | |
| 4,946,123 | A | 8/1990 | Albert | |
| 5,137,112 | A | 8/1992 | Nichols | |
| 5,143,171 | A | 9/1992 | Glynn et al. | |
| 5,165,642 | A | 11/1992 | Rihaly | |
| 5,248,021 | A | 9/1993 | Nichols | |
| 5,282,597 | A | 2/1994 | Babcock | |
| 5,287,944 | A | 2/1994 | Woodyard | |
| 5,346,036 | A | 9/1994 | Arisman et al. | |
| 5,361,558 | A | 11/1994 | Thornton et al. | |
| 5,370,202 | A | 12/1994 | Nichols | |

(Continued)

FOREIGN PATENT DOCUMENTS

| | | | |
|---|---|---|---|
| GB | 2146368 A | * | 4/1985 |
| GB | 2251020 | | 6/1992 |
| GB | 2291100 | | 1/1996 |
| GB | 2397845 | | 8/2004 |

OTHER PUBLICATIONS

Super Anchor Safety, Fall Protection Equipment, Full Line Catalog, 2004, 28 pages.

*Primary Examiner* — Robert Canfield
*Assistant Examiner* — Babajide Demuren
(74) *Attorney, Agent, or Firm* — Sand & Sebolt

(57) ABSTRACT

A roof safety anchor assembly for securing a safety lanyard to a roof truss. The assembly includes an anchor plate secured to the roof truss, an edge protector secured to an edge of a sheet of sheathing attached to the roof truss; and a choke cable secured to the anchor plate at a first end and to the lanyard and passing over the protector therebetween. The protector includes a cylindrical member having a bore therethrough and a longitudinal slot extending between the first and second ends of the protector. The slot is expandable to receive the edge of the sheathing therein. The protector includes a recess configured to receive a truss member therein when the sheathing is engaged to the truss member. In the event of a fall, the forces applied to the lanyard are redirected by the protector vertically into the anchor plate.

12 Claims, 7 Drawing Sheets

U.S. PATENT DOCUMENTS 5,553,685 A 9/1996 Cook
5,558,312 A 9/1996 Brennan
5,595,260 A 1/1997 Jalla
5,687,535 A 11/1997 Rohlf
5,727,646 A 3/1998 Gray
5,730,407 A 3/1998 Ostrobrod
5,737,878 A * 4/1998 Raulerson et al. ..... 49/462
5,850,889 A 12/1998 Rexroad et al.
5,896,719 A 4/1999 Thornton
6,098,746 A 8/2000 Castaneda
6,241,205 B1 6/2001 Affrunti
6,691,826 B1 2/2004 Dean
6,705,018 B2 3/2004 Guhse
6,763,910 B2 * 7/2004 Cole ..... 182/3
6,779,316 B2 8/2004 Carroll
6,786,020 B2 9/2004 Poldmaa
6,805,220 B2 * 10/2004 Fulton et al. ..... 182/3
6,877,291 B2 4/2005 Shamroukh et al.
6,966,531 B2 11/2005 Curtin
7,380,373 B2 6/2008 Crookston
2003/0051429 A1 3/2003 Hovenier
2009/0272064 A1 * 11/2009 Crookston ..... 52/692

* cited by examiner

SHEATHING EDGE PROTECTOR AND ROOF SAFETY ANCHOR ASSEMBLY INCORPORATING THE SAME

BACKGROUND OF THE INVENTION

1. Technical Field

This invention generally relates to safety systems. More particularly, the invention relates to a safety assembly for a roof anchor. Specifically, the invention relates to device that is engaged between a roof truss and a roof anchor safety assembly for distributing and attenuating the forces that would be applied to the roof sheathing in the event of a roofer falling while being secured to the truss by a safety harness.

2. Background Information

There are a variety of roof anchor safety systems that are used by roofers to ensure their safety while they are working on a roof. The safety harness is worn on the body and is connected by a steel cable to an anchor that is temporarily or permanently mounted on some region of the roof truss system. Should the roofer slip or fall, the cable connected to the anchor will tend to prevent them from falling off the roof and being severely injured.

One of the problems in previously known safety systems is that if the anchor is mounted adjacent on the peak and on the same side of the truss as where the roofer is working, then the steel cable extending between the anchor and the safety harness worn by the roofer will be fed over the edge of the sheathing attached to the truss. Since the cable is made from steel, if a roofer falls that cable can cause substantial damage to the plywood sheets that are used as sheathing, especially to the edge region which is in direct contact with the cable. This damage is essentially caused as the steel cable slams with force into the wood or plywood when the cable connected to the safety harness lanyard suddenly has to bear the roofer's full weight. The impact of the cable can slice and splinter the sheathing and potentially damage the structural integrity of the same.

There is therefore a need in the art for an improved safety anchor system that includes a force attenuation device that will tend to distribute and reduce the forces involved in the event of this type of accident and which will thereby tend to minimize the potential damage to the sheathing.

BRIEF SUMMARY OF THE INVENTION

A roof safety anchor assembly for securing a safety lanyard to a roof truss. The assembly includes an anchor plate secured to the roof truss, an edge protector secured to an edge of a sheet of sheathing attached to the roof truss; and a choke cable secured to the anchor plate at a first end and to the lanyard and passing over the protector therebetween. The protector includes a cylindrical member having a bore therethrough and a longitudinal slot extending between the first and second ends of the protector. The slot is expandable to receive the edge of the sheathing therein. The protector includes a recess configured to receive a truss member therein when the sheathing is engaged to the truss member. In the event of a fall, the forces applied to the lanyard are redirected by the protector vertically into the anchor plate. The protector physically deforms and prevents damage from occurring to the edge of the sheathing.

BRIEF DESCRIPTION OF THE SEVERAL VIEWS OF THE DRAWINGS

Preferred embodiments of the invention, illustrated of the best modes in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Referring to FIGS. 1-8 there is shown a roof safety anchor assembly in accordance with the present invention and generally indicated at 10. Safety anchor assembly 10 is configured to be engaged on a roof truss 12 and is designed to secure a first end of a safety lanyard 14 to truss 12. Although not illustrated herein, it should be understood that the second end of lanyard 14 is secured to a safety harness worn by a roofer.

Figure 7:
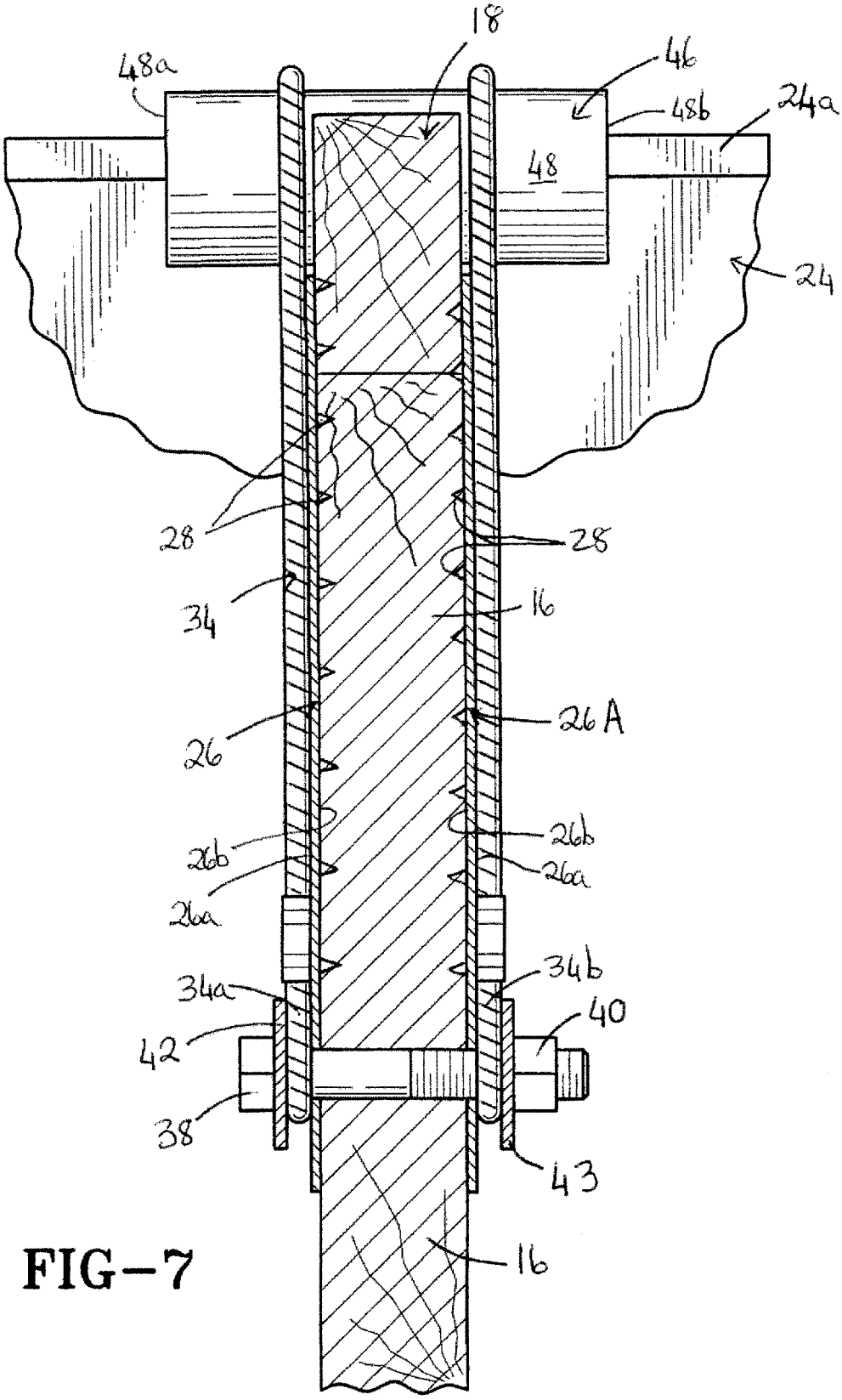
FIG. 7 is a cross-sectional right side view of the roof safety anchor assembly taken through line 7-7 of FIG. 1.

Truss 12 comprises a king post 16 which is secured to a first truss member 18 and a second truss member 20. First and second truss members 18, 20 are utilized to form a truss peak 22. In accordance with a specific feature of the present invention, king post, first truss member and second truss member 16, 18, 20 are at least partially secured to each other by way of one or more truss gusset plates such as anchor plate 26. Preferably, a second anchor plate 26A is secured in like manner to an opposite face of truss 12, as is illustrated in FIG. 7. Anchor plates 26, 26*a* are substantially identical and, consequently, only anchor plate 26 will be described in detail herein.

Figure 1:
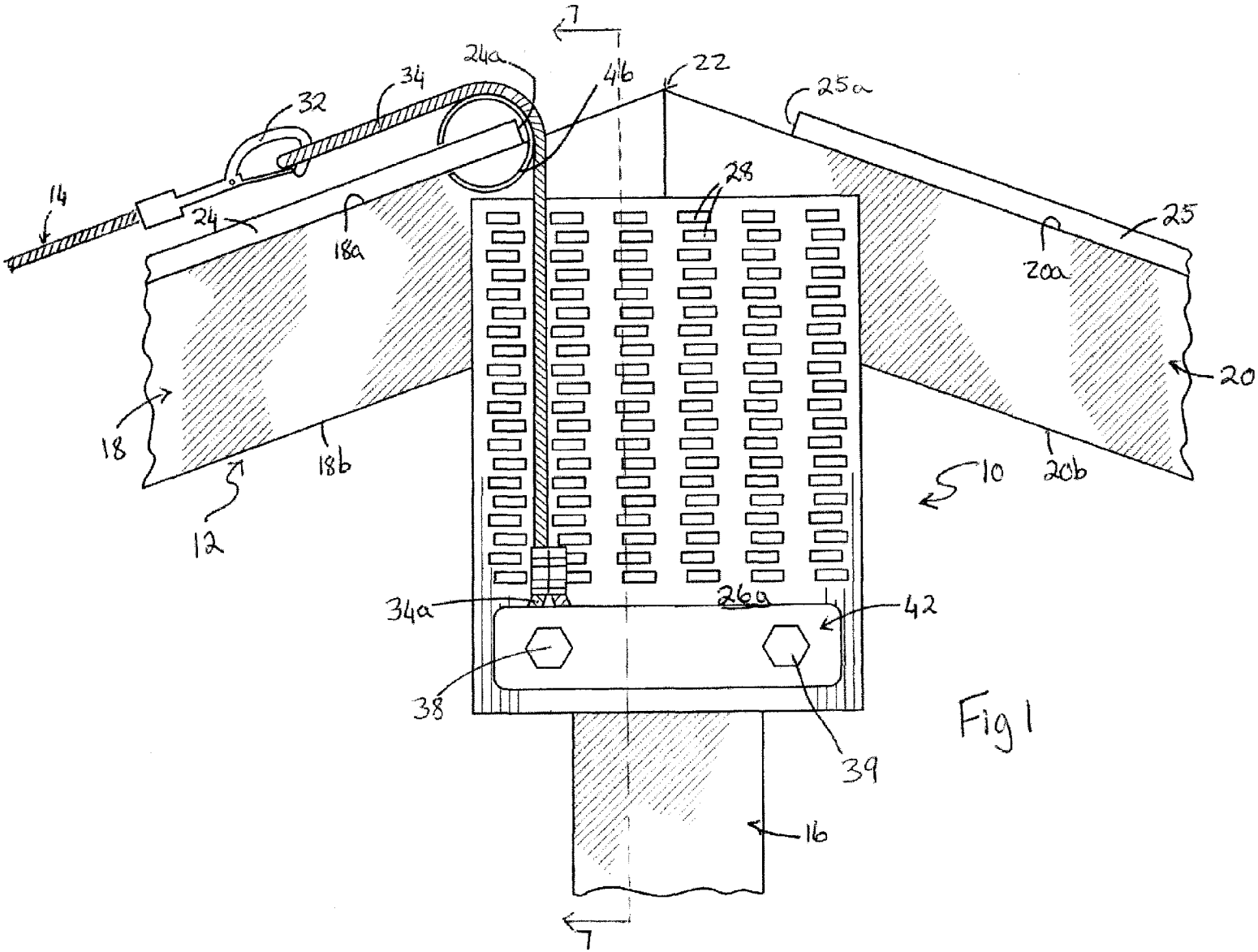
FIG. 1 is a front elevational view of a roof safety anchor assembly including a sheathing edge protector in accordance with the present invention.
Figure 2:
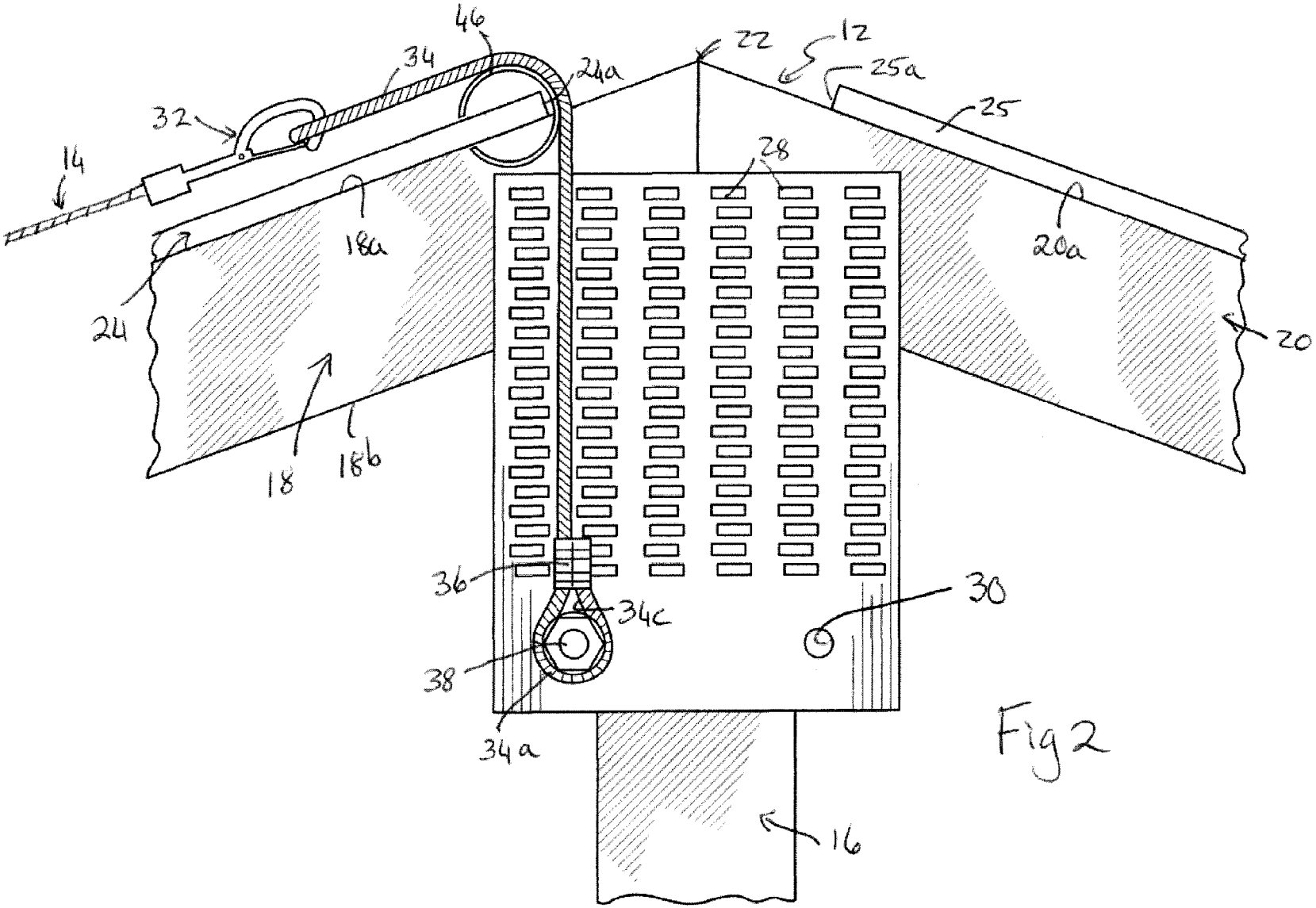
FIG. 2 is a front elevational view of the roof safety anchor assembly and sheathing edge protector with the strap washer removed and showing a flat washer used in its place.

Anchor plate 26 comprises a sheet of metal having a plurality of fasteners 28 extending outwardly from a rear surface 26*b* thereof and into the wood of the post and first and second truss members 16, 18, 20. Preferably, anchor plate 26 is manufactured from 18 gauge steel to accommodate the forces involved in arresting a fall. It will be understood, however, that other suitable gauges of steel may be utilized without departing from the scope of the invention. Anchor plate 26 may be of any suitable configuration such as any of the anchor plates disclosed in U.S. Pat. Nos. 7,380,373 and 7,832,153, both issued to the present inventor, Lawrence A. Crookston, and in copending U.S. patent application Ser. Nos. 12/766,568 and 12/100,122 to the same inventor. Anchor plate 26 defines one or more, preferably two, apertures 30 (FIG. 2) which are laterally spaced from each other and are positioned and configured to be used to secure safety lanyard 14 thereto either directly or indirectly. Preferably, when anchor plate 26 is engaged on truss 12, apertures 30 are positioned beneath peak 22. More particularly, and as illustrated in FIGS. 1 and 2, apertures 30 are positioned on anchor plate 26 so that when anchor plate 26 is engaged with truss 12, each aperture 30 is located beneath a lower surface 18*b*, 20*b* of the respective one of first and second truss members 18, 20. In the above-referenced patents and patent applications to the present inventor the connector 32 engaged with safety lanyard 14 would be directly engaged in one of apertures 30. More particularly, connector 32 would be engaged in the one of the apertures 30 that is located on the opposite side of the roof from where the roofer is working. In the present invention, however, the connector 32 to safety lanyard 14 is secured indirectly to apertures 30 by way of roof safety anchor assembly 10 as will be described hereafter.

Sheets of plywood, or sheathing, 24, 25 are secured to upper surfaces 18*a*, 20*a* of first and second truss members 18, 20 respectively using suitable fasteners (not shown). Shingles (not shown) are then applied to sheathing 24, 25 to complete the roof. The roofer will be attached to the safety anchor system and therefore to the roof safety anchor assembly 10 during the application of the shingles.

In accordance with the present invention roof safety anchor assembly 10 comprises one or more anchor plates 26, 26A, a choke cable 34 and an edge protector 46. Choke cable 34 has a first end 34*a* (FIG. 7) and a second end 34*b* and a length of cable extending therebetween. Both of the first and second ends 34*a*, 34*b* are looped back onto themselves and secured in that looped configuration by crimping members 36. Each of first and second ends 34, 34*b* defines an aperture 34*c* (FIG. 2) therein. In order to secure choke cable 34 to anchor plate 26, a bolt 38 is passed through a plurality of aligned elements. Specifically, bolt 38 is passed through aperture 34*c* in first end 34*a*, through the aperture 30 in anchor plate 26 that is on the same side of the roof as where the worker will be working, through an aligned aperture 30 on a second anchor plate 26A on the opposite side of truss 12, and through an aperture in second end 34*b* of cable 34. A nut 40 (FIG. 7) is engaged with bolt 38 to secure choke cable 34 and anchor plates 26, 26A together.

In accordance with yet another feature of the present invention and as shown specifically in FIG. 1, a strap washer 42 is preferably also included in roof safety anchor assembly 10. Strap washer 42 is a metal plate which preferably is manufactured from 14 gauge steel and is capable of resisting a 5000 lb deadload. Two spaced apart apertures (not shown) are defined in strap washer 42 in such positions that they are alignable with apertures 30 in anchor plates 26, 26A. Strap washer 42 is positioned so that it is disposed between the head of bolt 38 and first end 34*a* of cable 34. In other words, first end 34*a* of cable 34 is sandwiched between strap washer 42 and an outer surface 26*a* of anchor plate 26. A second bolt 39 and associated nut (not shown) secures strap washer 42 to the second aperture 30 in anchor plate 26. Although not illustrated herein, it will be understood that suitable spacer elements may be sandwiched between strap washer 42 and anchor plate 26 to ensure that an even distribution of force across strap washer 42 will occur should a roofer fall. It should further be noted that only one such strap washer 42 need be used in assembly 10 although two strap washers 42 may be utilized therein without departing from the scope of the invention. Bolt 38 is then passed through the one of the holes in strap washer 42, through first end 34*a* of choke cable 34, through aperture 30 in anchor plate 26, then through an aperture 30 in the second anchor plate 26A on the opposite side of king post 16, and through the second end 34*b* of choke cable 34, and through a flat washer 43 (FIG. 7). Nut 40 is then engaged with bolt 38 to secure all the components together. Not only does strap washer 42 increase the strength of assembly 10, but the washer also aids in preventing bolt 38 from pulling out of anchor plates 26, 26A in the event of a roofer falling.

Figure 3:
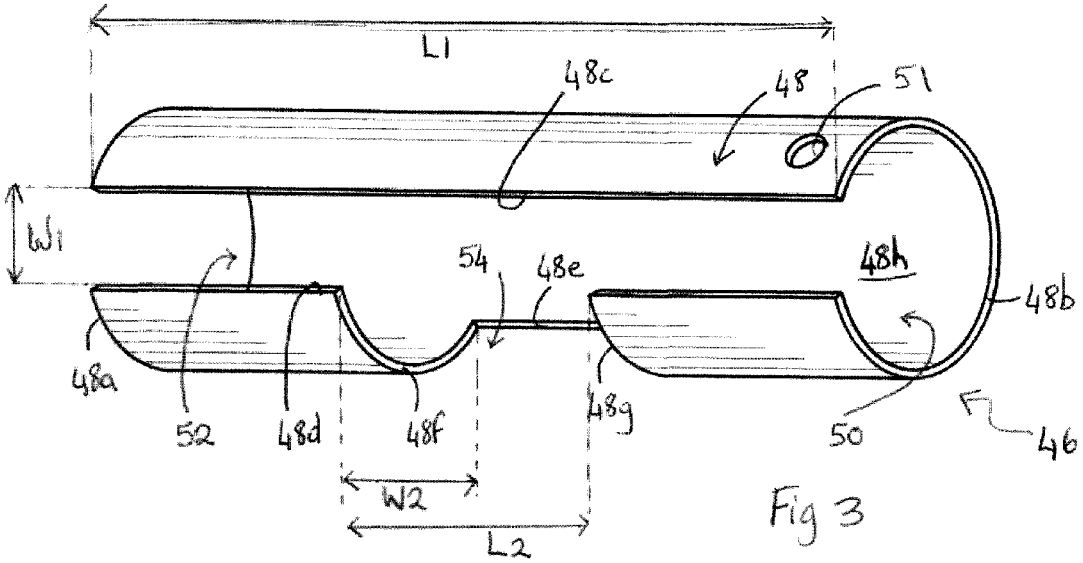
FIG. 3 is a perspective view of the edge protector in accordance with the present invention.
Figure 4:
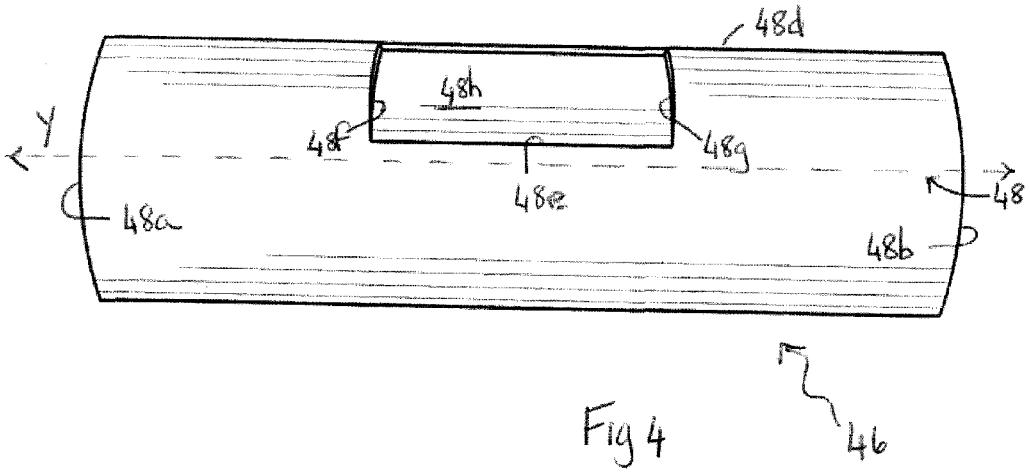
FIG. 4 is a bottom view of the edge protector of FIG. 3.
Figure 5:
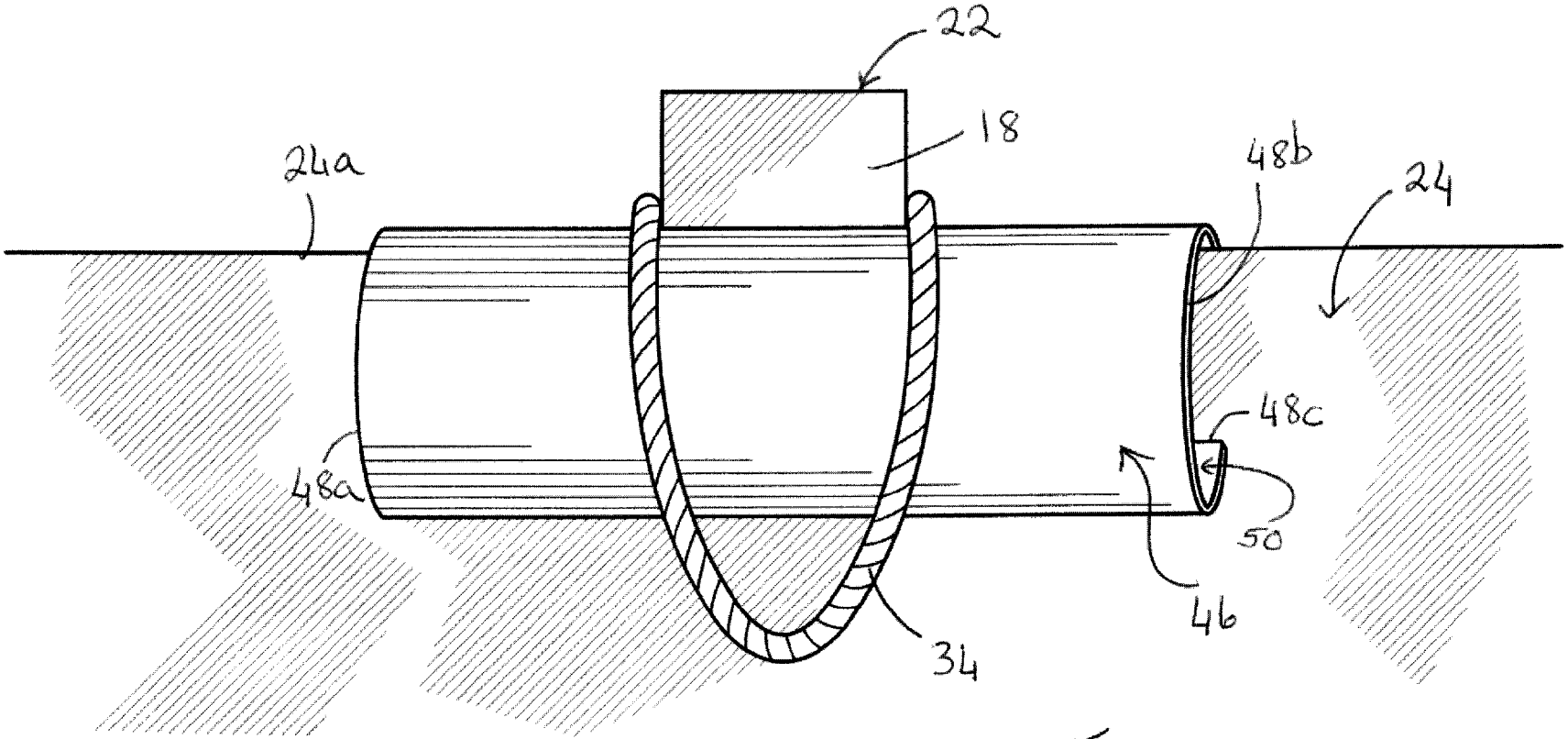
FIG. 5 is a left side view of the edge protector shown engaged with an edge of a sheet of sheathing and having the safety lanyard connector removed for clarity.
Figure 6:
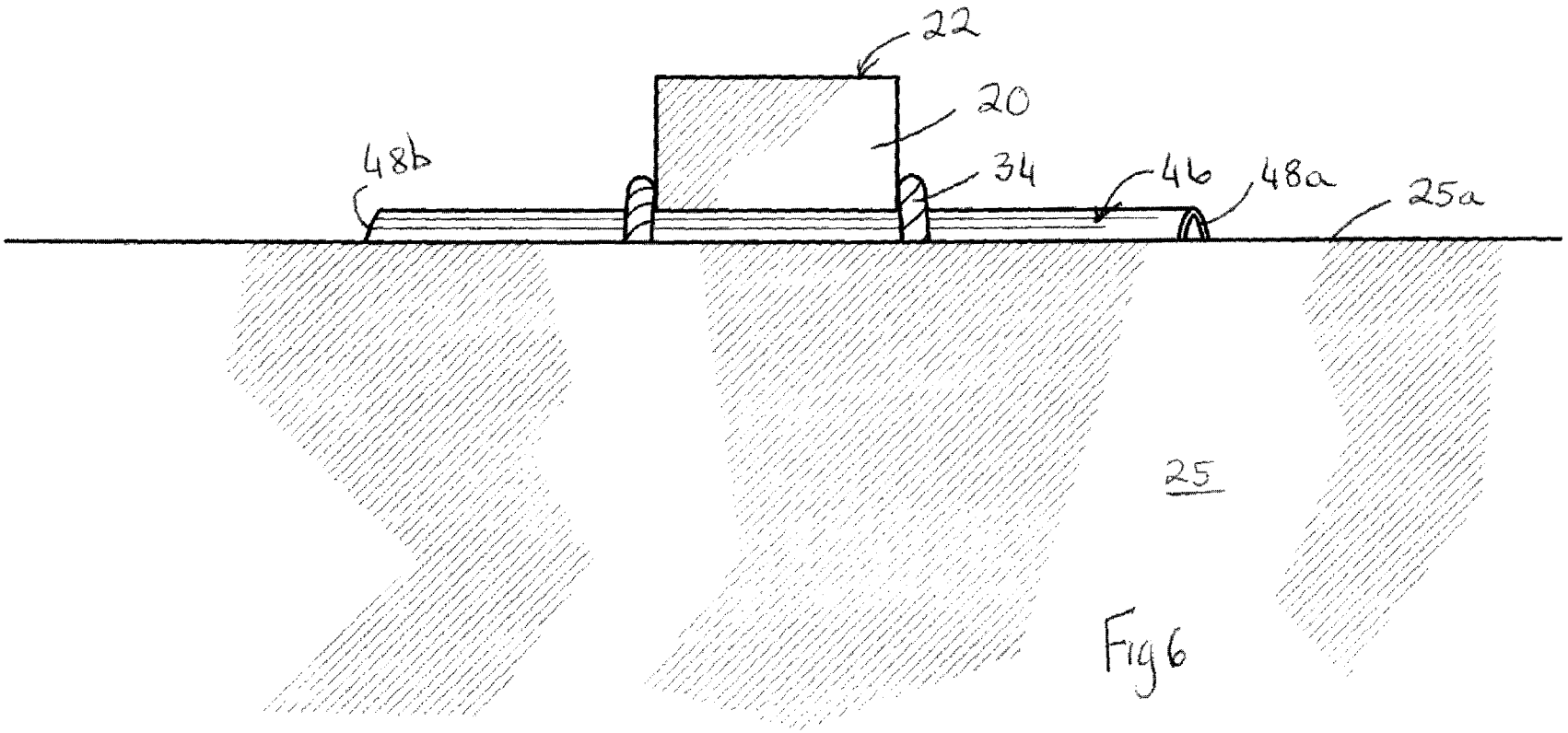
FIG. 6 is a right side view of the edge protector as shown in FIG. 5.

As indicated previously and in accordance with another specific feature of the present invention, roof safety anchor assembly 10 further includes sheathing edge protector 46. Edge protector 46 is engaged with an uppermost edge of the one of the sheets of plywood 24, 25 which is on the same side of the roof here the roofer is working. So, as illustrated in FIG. 1, edge protector 46 is engaged with upper edge 24*a* of sheathing 24. FIGS. 3 and 4 show edge protector 46 in greater detail. Edge protector 46 comprises a generally cylindrical member having a peripheral wall 48 with a first end 48*a* and a second end 48*b*. Edge protector 46 has a longitudinal axis "Y" that extends between first and second ends 48*a*, 48*b*. A longitudinal bore 50 is defined in peripheral wall 48 and is bounded by interior surface 48*h*. Bore 50 extends from first end 48*a* through to second end 48*b* thereof. Bore 50 is accessible through each of the first and second ends 48*a*, 48*b*. A longitudinally aligned slot 52 is defined in the peripheral wall 48 and slot 52 extends from first end 48*a* to second end 48*b* thereof. Slot 52 has a width "W" as measured between first and second longitudinal edges 48*c*, 48*d* of peripheral wall 48. Slot 52 further has a length "L1" as measured from first end 48*a* to second end 48*b* of edge protector 46. Preferably, edge protector 46 has a length "L1" of around 7 inches and a width "W1" of around 0.75 inches. Slot 52 is in communication with bore 50 and is at least temporarily expandable widthwise to permit edge 24*a* of sheathing 24 to be inserted therethrough and into bore 50. A hole 51 is defined in peripheral wall 48 proximate second end 48*b* of edge protector 46. Hole 51 is provided to enable a roofer to insert a length of rope or wire to which he or she may attach other tools to prevent the same from sliding off the roof.

Figure 8:
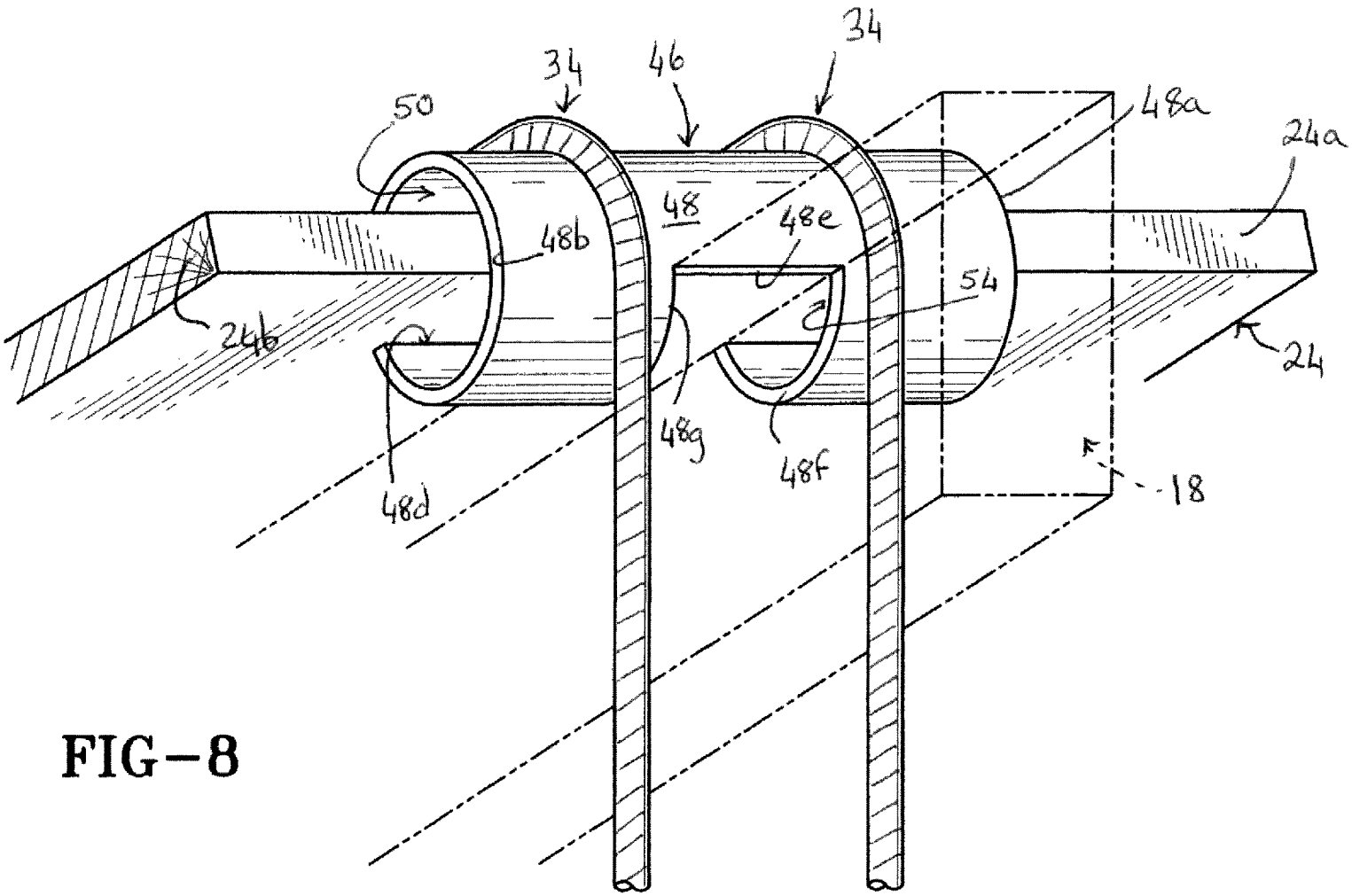
FIG. 8 is a right side perspective view of the edge protector engaged with a sheet of sheathing and with a truss member.

In accordance with yet another feature of the invention, edge protector 46 further defines a generally U-shaped recess 54 in peripheral wall 48. Recess 54 is defined generally equidistant from each of first and second ends 48*a*, 48*b* and extends for a distance circumferentially along peripheral wall 48. Recess 54 is bounded by longitudinal edge 48*e* and lateral edges 48*f*, 48*g*. Recess 54 is in communication with bore 50 and with longitudinal slot 52. Recess 54 has a width "W2" as measured circumferentially from longitudinal edge 48*d* to inward edge 48*e*, and has a length "L2" as measured between circumferential edges 48*f* and 48*g*. Recess 54 is configured to receive a portion of one of first and second truss members 18, 20 therein when edge protector 46 is engaged therewith. The engagement of first truss member 18 in recess 54 is illustrated in FIG. 8. Typically, first and second truss members 18, 20 are 2×4 inch pieces of lumber. Consequently, recess 54 preferably has a length "L2" that is sufficient to receive a portion of a side edge of such a 2×4 inch piece of lumber therein, i.e., length "L2" is about 2 inches long. Additionally, a sufficient portion of the piece of lumber needs to be captured by recess 54 so that edge protector 46 will not rotate and slide off sheathing 24 if a roofer falls. Preferably to prevent this from happening, recess has a width "W2" that is about 2 inches wide.

Assembly 10 is used in the following manner. During production of truss 12, anchor plates 26, 26A are secured to either side of king post 16 and first and second truss members 18, 20. This is accomplished by engaging fasteners 28 into the wood of post 16 and truss members 18, 20. When a roofer is ready to install sheathing 24, 20, he or she engages edge protector 46 on the one of the edges 24*a*, 25*a* of the sheets of sheathing 24, 25 that is on the same side of the roof as where he or she will be working. This is easily accomplished by enlarging the width "W1" of slot 52 using thumbs and forefingers of each hand. The installer then moves the edge protector 46 onto edge 24*a* ensuring that first truss member 18 is captured in recess 54 of edge protector 45. It should be noted that this typically place edge protector 46 a distance inwardly from side edge 24*b* of sheathing 24.

The installer will then secure choke cable 34 to anchor plates 26, 26A in the manner previously described herein. The length of choke cable 34 that extends between first and second ends 34*a*, 34*b* is then draped over edge protector 46 and the connector 32 secured to safety lanyard 14 is engaged with choke cable 34. As indicated previously, safety lanyard 14 is secured at its second end to a safety harness (not shown) worn by the roofer. If the roofer falls, the safety lanyard 14 will pull taut and the force will be transmitted through the connector 32 to choke cable 34 and then be redirected vertically by edge protector 46 into anchor plates 26, 26A and thereby to truss 12. The force effectively is applied substantially at right angles to the longitudinal axis of the edge protector 46. Edge protector 46 not only changes the direction of the force but also places a physical barrier between the steel choke cable 34 and the wood of sheathing 24. The impact of the force will cause edge protector to deform in shape and may cause it to be completely flattened at least along the upper surface of sheathing 24. The curved shape of edge protector 46 will be deformed upon application of the force due to the roofer falling, and this deformation will absorb part of the force applied to the cable 34. Additionally, the force will be somewhat transferred laterally along edge protector 46 by the two portions of the choke cable 34 that are in contact with edge protector 46. This again, in turn, protects the sheathing 24 by ensuring that is not sliced through by steel choke cable 34.

It will also be understood that the assembly 10 may be used in conjunction with a force attenuation device that is engaged with the peak 22 of truss member. Such a force attenuation device has been disclosed by the present invention in copending U.S. patent application Ser. No. 13/040,644, filed May 27, 2011, and entitled "FORCE DISTRIBUTION AND ATTENUATION DEVICE FOR USE IN A ROOF ANCHOR SAFETY SYSTEM", the entire specification of which is incorporated herein by reference.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A roof safety anchor assembly for securing a safety lanyard extending from a roofer's safety harness to a roof truss; said assembly comprising:

an anchor plate adapted to be secured to the roof truss;

an edge protector adapted to be secured to an upper edge of a sheet of sheathing that is attached to the roof truss; and a choke cable secured to the anchor plate at a first end and having a region adapted to be attached to the safety lanyard, and wherein a portion of said choke cable between the first end and the region thereof passes over an exterior surface of the edge protector.

2. The roof safety anchor assembly as defined in claim 1, wherein the edge protector comprises:

a cylindrical member having a peripheral wall with a first end and a second end and a longitudinal axis extending between the first and second ends thereof; and wherein the portion of the choke cable passes over the exterior surface of the cylindrical member;

a bore defined in the cylindrical member and being bounded by the peripheral wall, said bore extending between the first and second ends of the cylindrical member; and a slot defined in the peripheral wall and extending from the first end of the cylindrical member to the second end thereof; said slot being aligned generally parallel to the longitudinal axis of the cylindrical member and being adapted to receive a section of the upper edge of the sheet of sheathing therethrough.

3. The roof safety anchor assembly as defined in claim 2, wherein the slot is bounded by a first longitudinal edge and a second longitudinal edge of the peripheral wall, and wherein the edge protector further includes:

a recess defined in the peripheral wall, said recess originating at the first longitudinal edge and extending circumferentially for a distance along the peripheral wall, and wherein the recess is adapted to receive a region of a first truss member of the roof truss therein.

4. The roof safety anchor assembly as defined in claim 1, wherein the anchor plate comprises:

a planar metal sheet;

a plurality of connectors extending outwardly from a rear surface of the metal sheet and adapted to secure the metal sheet to the roof truss;

a first aperture defined in the metal sheet in a location that will not be obscured when the metal sheet is secured to the roof truss; and wherein the choke cable is detachably engageable with the metal sheet via the first aperture.

5. The roof safety anchor assembly as defined in claim 4, wherein the choke cable further includes a second end and a length of cable extends between the first and second ends thereof; wherein each of the first and second ends of the choke cable defines an aperture therein; and wherein the aperture in the first end of the choke cable is alignable with the first aperture in the metal sheet and is further alignable with the aperture in the second end of the choke cable, and wherein the assembly further comprises:

a first fastener that is receivable through the aligned apertures in the first and second ends of the choke cable and through the first aperture in the metal sheet.

6. The roof safety anchor assembly as defined in claim 5, wherein the metal sheet further comprises:

a second aperture defined in the metal sheet and spaced a distance laterally away from the first aperture therein; and wherein the assembly further comprises:

a strap washer; said strap washer defining a first hole and a second hole therein, wherein the first hole is positioned to align with the first aperture in the metal sheet and the second hole is positioned to aligned with the second aperture in the metal sheet, and the first fastener is additionally receivable through the first hole in the strap washer; and a second fastener that is receivable through the aligned second hole in the strap washer and through the second aperture in the metal sheet.

7. The roof safety anchor assembly as defined in claim 1, wherein in the event of a fall by the roofer secured to the safety lanyard, the edge protector is adapted to redirect the forces so generated vertically through the anchor plate.

8. A safety anchor system for a roofer comprising:

a safety lanyard adapted to be secured at a first end to a safety harness worn by a roofer;

a roof safety anchor assembly secured to a second end of the safety lanyard, said roof safety anchor assembly being adapted to be secured to a roof truss; and wherein said roof safety anchor assembly comprises:

a first anchor plate and a second anchor plate, wherein the first anchor plate is secured to a first side of the roof truss and the second anchor plate is secured to a second side of the roof truss;

an edge protector adapted to be secured to an upper edge of a sheet of sheathing attached to an upper surface of the roof truss; and a choke cable having a first end secured to the first anchor plate and a second end secured to the second anchor plate; and wherein a length of the choke cable disposed between the first and second ends thereof is secured to the second end of the safety lanyard, and wherein a portion of the length of the choke cable disposed between the anchor plates and the safety lanyard extends over an exterior surface of the edge protector.

9. The safety anchor system as defined in claim 8, wherein the edge protector comprises:

a cylindrical member having a peripheral wall with a first end and a second end and a longitudinal axis extending between the first and second ends thereof; and wherein the portion of the choke cable passes over the exterior surface of the cylindrical member;

a bore defined in the cylindrical member and being bounded by the peripheral wall, said bore extending between the first and second ends of the cylindrical member; and a slot defined in the peripheral wall and extending from the first end of the cylindrical member to the second end thereof; said slot being aligned generally parallel to the longitudinal axis of the cylindrical member and being adapted to receive a section of the upper edge of the sheet of sheathing therethrough.

10. The safety anchor system as defined in claim 9, wherein the slot is bounded by a first longitudinal edge and a second longitudinal edge of the peripheral wall, and wherein the edge protector further includes:

a recess defined in the peripheral wall, said recess originating at the first longitudinal edge and extending circumferentially for a distance along the peripheral wall, and wherein the recess is adapted to receive a portion of a first truss member of the roof truss therein, and wherein engagement of the first truss member within the recess substantially prevents lateral motion of the edge protector along the edge of the sheet of sheathing.

11. The safety anchor system as defined in claim 10, wherein the slot has a width as defined between the first and second longitudinal edges of the peripheral wall, and wherein the width is expandable to receive the edge of the sheet of sheathing therein.

12. The edge protector as defined in claim 11, wherein the edge protector is generally C-shaped when viewed from one of the first and second ends thereof, and wherein the edge protector is compressible upon application of a force thereto when the force is applied generally at right angles to the longitudinal axis of the edge protector.

* * * * *